United States Patent [19]

Morgan et al.

[11] Patent Number: 4,896,383

[45] Date of Patent: Jan. 30, 1990

[54] WATER TANK JET

[76] Inventors: Dean W. Morgan, 115 Woodland Trail, Leander, Tex. 78641; Walter R. Morgan; Cindy S. Heller, both of 1737 Berwin La., Eugene, Oreg. 97407

[21] Appl. No.: 176,383

[22] Filed: Mar. 31, 1988

[51] Int. Cl.[4] ..... A61H 33/02

[52] U.S. Cl. ..... 4/542; 4/491; 4/492; 4/541; 239/318; 239/229

[58] Field of Search ..... 4/491, 492, 541, 542; 128/66; 239/318, 229, 432, 572; 366/119

[56] References Cited

U.S. PATENT DOCUMENTS

| | | | |
|---|---|---|---|
| 3,278,165 | 10/1966 | Gaffney | 366/119 |
| 3,408,050 | 10/1968 | Jacobs | 366/119 |
| 3,629,877 | 12/1971 | Schuster | 4/491 |
| 4,207,877 | 6/1980 | Marquardt | 128/66 |
| 4,365,752 | 12/1982 | Waisbren et al. | 128/66 X |
| 4,523,340 | 6/1985 | Watkins | 4/542 |
| 4,572,165 | 2/1986 | Dodier | 4/542 X |
| 4,679,258 | 7/1987 | Henkin et al. | 4/492 X |
| 4,692,950 | 9/1987 | Henkins et al. | 4/542 |

FOREIGN PATENT DOCUMENTS

| | | | |
|---|---|---|---|
| 47116 | of 0000 | France | 4/541 |

OTHER PUBLICATIONS

Hydro Air Industries Inc. of Orange, California advertisement for "Micro'ssage: The Great Spin Off" (undated).

*Primary Examiner*—Stephen Marcus
*Assistant Examiner*—Christine A. Peterson
*Attorney, Agent, or Firm*—Arnold, White & Durkee

[57] ABSTRACT

An apparatus for discharging a moving fluid stream into a spa tank or the like for subjecting a user's body to the massaging action of the stream, the apparatus having a substantially rigid guide means mounted to the housing of the device which reciprocates between two positions in response to the movement of the fluid stream.

9 Claims, 1 Drawing Sheet

WATER TANK JET

BACKGROUND OF THE INVENTION

1. Field of the Invention

The present invention relates generally to an apparatus for discharging a fluid stream such as water and air into a water tank such as a spa, bath tub, or the like, and more particularly to a fluid discharge fixture to be mounted in the wall of a spa or bath tub for creating a moving fluid stream having a massaging action for impact against a user's body.

2. Description of the Prior Art

Oversized water tanks such as bath tubs and spas have become increasingly popular in recent years due to their medicinal and recreational qualities. An integral part of many of these spas and tubs is the use of moving fluid streams, such as pressurized streams of water with entrained air, being jetted into such tubs. This moving water is used not only to circulate the water used within the tub through filtering and pumping devices but also used to massage the user's body in a pleasant and often times therapeutic manner. Ideally, such discharge devices provide a pulsating-like or moving fluid stream which changes direction in such a manner as to create a massaging action. It is desirable that such massaging action be created by a device which is simple to install and operate without complicated mechanical devices which are prone to severe maintenance problems.

The prior art as exemplified by U.S. Pat. Nos. 4,523,340 and 4,692,950 is generally illustrative of various apparatus and method for injecting the fluid stream into a spa or bath tub. While such devices are generally acceptable for their intended purpose, they have not proven to be entirely satisfactory in that they are complex and expensive to manufacture, are bulky and inconvenient to install, and typically utilize a complicated mechanical mechanism which increases the likelihood of malfunctions and needed repair.

As a result of the shortcomings of the prior art, typified by the above, there has developed and continues to exist a substantial need for a simple yet efficient device for discharging a moving fluid stream into a spa tank or the like which is inexpensive, easy to install, safe to use and operate, and easy to clean and repair. Despite this need and the efforts of many individuals and companies to develop such a device, an inexpensive, efficient discharge apparatus has heretofore been unavailable.

SUMMARY OF THE INVENTION

It is therefore a feature of the present invention to construct an apparatus for discharging a moving fluid stream into a spa tank or the like which provides a massaging action to the user's body through the use of an uncomplicated apparatus having a minimum of moving parts.

Another feature of the present invention is to construct an apparatus for discharging fluid into a spa tank or the like which operates over a wide range of fluid flow rates and which may be mounted in the wall of the tank either vertically or horizontally such that the moving fluid stream swings in a horizontal or a vertical direction.

The present invention has a further feature in the provision of an apparatus for discharging a fluid stream into a spa tank or the like which will fully drain when not in use thereby being easily cleaned and free from damage due to extreme weather conditions.

A still further feature of the present invention is the construction of a fluid discharge apparatus for installation in a spa tank or the like which is easily and quickly installed in new as well as existing tanks by requiring little space for installation.

A still further feature of the present invention is the construction of a discharge apparatus which is easily and quickly installed in spas as well as residential bath tubs.

The present invention is advantageous over the prior art in that the same is economical to construct, is safe to use, quickly and easily cleaned and repaired, and effectively achieves the advantages of providing a moving fluid stream which provides a massaging action to the body of the user in a manner which is efficient yet economical.

The present invention is summarized in that an apparatus for discharging a fluid stream into a spa tank or the like includes a housing having an inlet and an outlet for receiving and discharging the fluid stream, a supply means for providing the pressurized fluid to the inlet of the housing and a guide means pivotally mounted to the housing and having at least one free end which is positioned within the housing and adjacent to the inlet. This guide means is adapted for reciprocating between first and second positions in order to redirect the fluid stream as it flows within the housing.

Other features and advantages of the present invention will become apparent from the following description of the preferred embodiment when taken in conjunction with the accompanying drawings.

DETAILED DESCRIPTION OF THE PREFERRED EMBODIMENTS

Figures 1, 2, 3, 4, 5:
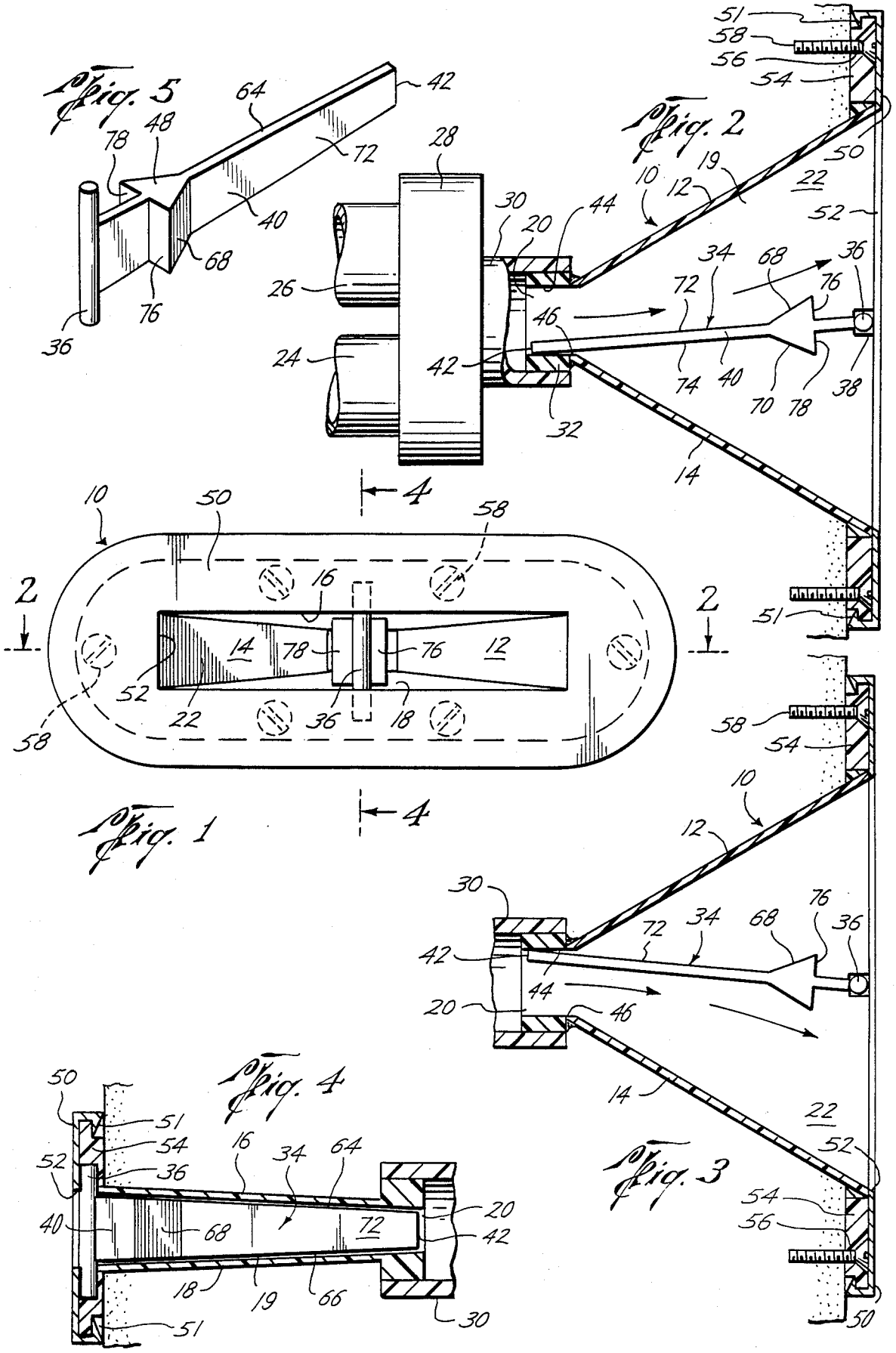
FIG. 1 is a front view of an apparatus in accordance with the present invention.
FIG. 2 is a sectional view taken substantially along the plane 2—2 of FIG. 1 with the guide means shown in its first position.
FIG. 3 is a sectional view similar to that depicted in FIG. 2 but illustrating the guide means in its second position.
FIG. 4 is a sectional view taken substantially along the plane 4—4 of FIG. 1.
FIG. 5 is an isometric view of the guide means in accordance with one embodiment of the present invention.

Referring to FIGS. 1–3, a preferred embodiment of a discharge apparatus in accordance with the present invention includes a generally fan-shaped housing 10 formed by top and bottom members or surfaces 12, 14 joined to opposing sidewalls 16, 18. These members or surfaces, 12, 14, 16, and 18 are joined together such that the housing forms a tapered, internal chamber 19 converging down to inlet 20 at one end. A larger, elongated outlet 22 is provided at the opposed end of the housing where the fluid stream is discharged from housing 10.

As shown in FIG. 2, there is provided a means for supplying a fluid stream to inlet 20 of housing 10. In the embodiment of FIG. 2, this means for providing a fluid stream includes water conduit 24 in which pressurized water is provided from an external source (not shown). Air is supplied to the device through air conduit 26. Both air conduit 26 and water conduit 24 are connected to manifold body 28 which serves to allow entrainment of the air into the pressurized water and form a single fluid stream which enters manifold outlet 30. Operation of manifold body 28 to combine the air and water streams is well known in the art and it is believed further explanation is not necessary.

Manifold outlet 30, a portion of the supply means, is connected to housing 10 in a manner such that the pressurized air and water stream flows out manifold outlet 30 through housing inlet 20 and into internal chamber 19 of housing 10. One embodiment of the present invention is shown in FIG. 2 where manifold outlet 30 is connected to housing 10 by means of inserting a portion of the housing into the opening formed in manifold outlet 30. For example, and without limitation, the embodiment shown in FIG. 2 calls for the housing 10 to include a boss or inlet base 32 to be glue fitted within manifold outlet 30 as shown in FIG. 2. However, as can be readily understood, the use of a glue fit between inlet base 32 and manifold outlet 30 is not necessary and may be replaced by alternative, conventional means of making such a connection when attaching a piece such as manifold outlet 30 to housing 10, as for example a threaded connection or an external clamp circumferentially mounted about manifold outlet 30. Alternatively, inlet base 32 may be fitted directly to manifold body 28 as can be understood by one skilled in the art.

Referring again to FIGS. 2 and 3, a substantially rigid guide means 34 is shown pivotally mounted to housing 10 across the central portion of outlet 22. Attached to one end of guide means 34 is pivot pin 36 which is rotatably mounted within notch 38 formed in sidewalls 16, 18 as shown in FIG. 2. Guide means 34 also includes arm portion 40 which extends from pivot pin 36 inwardly within chamber 19 of housing 10 to inlet 20 as shown in FIG. 2. Arm 40 extends within housing 10 such that its free end 42 is positioned in close proximity to inlet 20. In the embodiment shown in FIGS. 2 and 3, free end 42 extends into inlet base 32 such that it may contact internal surfaces 44, 46 of inlet base 32.

Guide means 34 also includes a projection means for engaging a portion of the fluid stream as it passes along 15 arm 40 from out of inlet 20. This portion of the fluid stream which is engaged by the projection means is sufficient to reciprocate guide means 34 between the first position as shown in FIG. 2 and the second position as shown in FIG. 3.

Guide means 34 and in particular pivot pin 36 may be retained in notch 38 by use of face plate 50 which is secured about the periphery of housing 10 as shown in FIGS. 1 and 4. Face plate 50 includes a window or face plate outlet 52 which is aligned with housing outlet 22 such that the fluid stream may pass from internal chamber 19 of housing 10 through housing outlet 22 and face plate outlet 52 and enter the water tank which typically has sufficient water so that the injection fluid stream is below the surface of the contained water. As shown in FIGS. 1 and 4, face plate 50 serves as a cover across the front of housing 10 and extends around outlet 22 of housing 10. Housing 10 also includes mounting flange 54 which forms a circumferential support collar about the outer periphery of housing outlet 22. Additionally, mounting flange 54 may include multiple apertures 56 which may accommodate a means, such as screws 58, securely attaching flange 54 and therefore housing 10 to the wall of the spa tank or bath tub wall.

Face plate 50 may be removably attached to flange 54 by any of several means. For example, plate 50 may be fabricated of a resilient material, such as plastic, that may be deformed about its outer edges. Such deformation allows plate 50 to be snapped into place and retained by face plate tabs 51 selectively located about the outer periphery of plate 50. As can be understood by one skilled in the art, attachment of face plate 50 to housing 10 may be accomplished by any of several attachment means such as screws.

During installation, an opening is typically formed in the sidewall of the tank which is sufficient to accommodate housing 10. Housing 10 is then inserted into the opening of the tank wall such that mounting flange 54 engages the periphery of the opening formed in the tank wall with the tank wall providing sufficient support for mounting the subject apparatus. Once the housing has been inserted into the opening of the tank wall and properly supported by the wall, guide means 34 is positioned within housing 10 by inserting pivot pin 36 into notch 34 with guide means 34 being free to swing between its first and second positions. Once guide means 34 is correctly positioned in notch 38, face plate 50 may then be positioned adjacent to the exterior surface of mounting flange 54 and held in position by tabs 51 as previously described. As can be appreciated by one skilled in the art, alternative means for mounting the subject apparatus securely within the wall of a tank are available and are easily adaptable to the subject invention.

Referring now to FIG. 4, the guide means 34 can be seen properly positioned within internal chamber 19 of housing 10. Opposed end 42 of arm 40 is shown extending into inlet base 32 such that when guide means 34 occupies its first and second positions as shown in FIGS. 2 and 3, a portion of the arm 40 contacts the internal surfaces 44, 46 of inlet base 32. Therefore, inlet base 32 serves to limit the extent of swing or movement of guide means 34. While the particular embodiment of FIGS. 2, 3, and 4 disclose the use of the internal surfaces 44, 46 of inlet base 32 as a means for limiting the extent of the reciprocating motion of guide means 34, it can be appreciated that other stop means may take alternative forms such as stop pins or posts appropriately positioned within the internal chamber of housing 10.

Referring now to FIG. 5, guide means 34 is shown in greater detail. As seen in FIG. 5, blade or arm portion 40 is shown as an elongated bar member with pivot pin 36 connected to one end of arm 40. From pivot pin 36, arm portion 40 gradually tapers downwardly such that when fitted within the internal chamber 19 of housing 10 upper and lower edges 64, 66 of arm 40 are substantially parallel to the opposed sidewalls 16, 18 of housing 10 as more clearly shown in FIG. 4.

Referring back to FIG. 5, projection 48 is attached to the arm 40 and extends outwardly. In the particular embodiment shown in FIG. 5, projection 48 is shown in the form of a wedge or ramp-shaped member extending outwardly from both sides of arm portion 40. In FIGS. 2 and 5, projection means 48 includes ramp surfaces 68, 70 extending outwardly from side surfaces 72, 74 of arm 40. Ramp surfaces 68, 70 intersect back surfaces 76, 78 of projection means 48. Back surfaces 76, 78 extend substantially perpendicular to side surfaces 72, 74 of arm 40. While projection means 48 is shown as a generally wedge shaped member in FIG. 5, such projection means may take various forms and shapes which are adequate to engage a portion of the fluid stream as will be described. As for example, a simple perpendicular tab projecting from surfaces 72, 74, as opposed to utilizing ramp surfaces 68, 70 would appear to be adequate. It is believed that projection means 48 may take any of several shapes as long as it provides a member which projects from side surfaces 72, 74 to present a surface which may be engaged by a portion of the fluid stream flowing within housing 10. It is believed that a portion of the fluid stream flowing within housing 10 pushes against the projecting surface of projection means 48, such as surfaces 68, 70, to cause guide means 34 to rotate about pivot pin 36 thereby causing guide means 34 to reciprocate between its first and second position.

The embodiment of FIG. 5 described above may be modified without departing from the subject invention. For example, even though pivot pin 36 is shown as being attached to one end of arm 40, it is believed that pin 36 may be mounted inwardly from this end along the length of arm 40 and remain operational. Also, the location within housing 10 when pivot pin 36 is mounted may also be altered by moving this location inwardly into chamber 19 from outlet and remain operational.

Referring back to FIGS. 2 and 3, operation of the subject device will now be explained. During operation, water is supplied by water conduit 24 to manifold body 28. Air to be entrained within the water stream is supplied by air conduit 26 to manifold body 28. Within manifold body 28, air is entrained within the pressurized water stream such that a pressurized fluid jet containing both air and water is supplied by manifold body 28 through manifold outlet 30 to housing inlet 20. The fluid stream passes through housing inlet 20 and past guide means 34 along its side surface 72 as shown in FIG. 2 when guide means 34 is in its first position of FIG. 2. As the pressurized fluid flows outwardly through the flow path defined by top member 12, sidewalls 16, 18 and guide means 34, with a portion flowing along side surface 72, a portion of the fluid stream engages surface 68 of projection means 48 and pushes against ramp surface 68. Since this component of the fluid stream creates a resultant force on projection means 48 which is offset from pivot pin 36, projection 48 serves as a moment arm to cause rotation of guide means 34 about pivot pin 36 in an upward direction as viewed in FIG. 2, resulting in guide means 34 being rotated to the second position shown in FIG. 3. The extent of rotary movement of guide 34 is restricted by end 42 of arm 40 engaging internal surface 44 as previously described. Once guide means 34 is in its second position as shown in FIG. 3, substantially all of the fluid stream passing through inlet 20 is redirected from the upper flow path of the internal chamber of housing 10 as shown in FIG. 2 to a lower flow path in the lower portion of the internal chamber of housing 10 formed by surfaces 14, 16, 18 and guide surface 74 as shown in FIG. 3. Therefore the resultant fluid stream exiting from outlet 22 is redirected from the upward direction shown in FIG. 2 to the downward direction shown in FIG. 3.

Referring to FIG. 3, when guide means 34 occupies its second position, the fluid stream entering inlet 20 passes along side surface 74 with a portion of the flowing stream striking surface 70 of projection means 48 in a manner as previously described sufficient to cause rotation of the guide means 34 back to the first position. A shifting of guide means 34 from its first to its second position and back again therefore results in a moving fluid stream which changes direction as the guide means reciprocates between its two positions. This change in direction of the moving fluid stream thereby causes a massaging action similar to a pulsing action which can be directed to a selected portion of a user's body for realization of a massaging effect.

The converging or tapered feature of housing 10 is seen in FIGS. 2 and 4. When the subject apparatus is installed vertically or with the longitudinal axis of outlet 22 vertically oriented as shown in FIG. 4, surfaces 12, 14 are inclined such that the moving stream is directed in an upward and downward direction. Additionally, when installed in this manner, the surface 14 allows water to fully drain from the chamber 19 when the water level in the tank is lowered below outlet 22. Such drainage is quite advantageous for cleaning purposes and during extremely cold weather conditions when substantially complete drainage of water from the system is necessary to avoid damage.

These same advantages are also available with the subject invention when it is installed horizontally or with the longitudinal axis of outlet 22 horizontally as shown in FIG. 1. Drainage of chamber 19 is provided by the tapered or inclined orientation of sidewalls 16, 18 as shown in FIG. 4.

It should be understood that while one embodiment of the present invention calls for the use of a housing 10 shaped as previously described, it is believed that the shape of housing 10 could be varied by one skilled in the art without departing from the spirit and teaching of the present invention.

Further modifications and alternative embodiments of the apparatus of this invention will be apparent to one skilled in the art in view of this description. Accordingly, this embodiment is to be construed as illustrative only, and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. An apparatus for discharging a fluid stream into a spa tank or the like for subjecting a user's body to the massaging action of a moving fluid stream, said apparatus comprising:

a housing having an inlet for receiving said fluid stream and an outlet for discharging said stream;

supply means for providing the fluid stream to the inlet of the housing; and a substantially rigid guide means having one end pivotally mounted to the housing and its free, opposed end positioned adjacent the inlet of said housing, said guide means being adapted for reciprocating between first and second positions in response to said fluid stream to redirect the fluid stream within the housing.

2. The apparatus of claim 1 wherein said guide means includes projection means for engaging a portion of said fluid stream sufficient to reciprocate said guide means between said first and second positions.

3. The apparatus of claim 1 wherein said guide means includes an arm portion;

a pivot pin connected to said arm portion for pivotally mounting said arm portion to said housing; and a projection means attached to the arm portion for engaging a portion of said fluid stream sufficient to reciprocate said arm portion between said first and second positions.

4. The apparatus of claim 3 wherein said projection means includes a wedge shaped member extending outwardly from the arm portion.

5. The apparatus of claim 1 wherein said housing includes opposing top and bottom surfaces diverging from said inlet to said outlet; and opposing sidewalls connected between said top and bottom surfaces, said sidewalls diverging from said inlet to said outlet.

6. The apparatus of claim 5 wherein said top and bottom surfaces are tapered.

7. An improved apparatus for injecting a moving fluid stream into a spa tank or the like for subjecting a user's body to the massaging action of the moving fluid stream, said apparatus comprising:

a housing having a hollow internal chamber;

inlet means for supplying the fluid stream to the housing chamber;

outlet means for conducting the fluid stream out from the housing chamber; and a substantially rigid guide means pivotally mounted within said housing chamber and having one end positioned adjacent said inlet means, said guide means being adapted for reciprocating between first and second positions in response to said fluid stream to define a plurality of flow passages between said inlet means and said outlet means.

8. The apparatus of claim 7 wherein said guide means includes an arm portion;

a pivot pin connected to said arm portion and adapted for pivotally mounting said arm portion within said housing chamber; and projection means attached to the arm portion.

9. The apparatus of claim 8 wherein the projection means is a wedge shaped member extending outwardly from the arm portion.

* * * * *